United States Patent [19]

Sabala

[11] Patent Number: 5,003,443

[45] Date of Patent: Mar. 26, 1991

[54] ILLUMINATED DISPLAY APPARATUS

[76] Inventor: Edwin K. Sabala, 14100 Walsingham Road, No. 20, Largo, Fla. 34644

[21] Appl. No.: 561,200

[22] Filed: Aug. 1, 1990

[51] Int. Cl.[5] ..... H01Z 33/00

[52] U.S. Cl. ..... 362/226; 362/249; 362/812; 439/110; 40/552

[58] Field of Search ..... 362/226, 236, 237, 238, 362/227, 249, 252, 806, 812; 439/110, 111, 113; 40/551, 552

[56] References Cited

U.S. PATENT DOCUMENTS

| | | | |
|---|---|---|---|
| 1,525,152 | 2/1925 | Roylance | 40/551 |
| 2,671,887 | 3/1954 | Wellman | 439/113 |
| 3,061,810 | 10/1962 | Boyd | 439/113 |
| 3,404,475 | 10/1968 | Coad | 40/552 |
| 3,447,253 | 6/1969 | Coad | 40/552 |
| 4,028,828 | 6/1977 | Chao et al. | 46/551 |
| 4,951,405 | 8/1990 | Sabala | 40/551 |

*Primary Examiner*—Stephen F. Husar
*Assistant Examiner*—Richard R. Cole
*Attorney, Agent, or Firm*—Charles E. Lykes, Jr.

[57] ABSTRACT

An apparatus for facilitating the attractive and simple display of an illuminated address or sign comprising an elongated cover, which is adapted with slots for plugs; one or more illumination figures; and electrical conduction strips. The apparatus may further be adapted with mounting and weatherproof covering members for outdoor use and also with an automatic on/off switch for power conservation. The device is meant to facilitate the simple modification, installation, and interchange of any desired pattern of illuminated numbers or letters.

9 Claims, 4 Drawing Sheets

40
31
10
32
85
84
72
12
11
13
20
30

96
40
40

40

43
18

10
93
95
96

ILLUMINATED DISPLAY APPARATUS

BACKGROUND OF THE INVENTION

The invention relates to illuminated signs, particularly those designed to convey identifying or locational information such as business names or street addresses.

A number of inventions teach apparatus and methods for providing an illuminated display for the letters and numerals of identifications of addresses and business identities. Most of this prior art, however, concerns articles which are specifically prepared for a single display and cannot be readily changed to make a different display.

U.S. Pat. No. 4,611,265, issued to Davis (9/9/86) teaches a lighted address display in which the light from an incandescent bulb is reflected into a translucent wall upon which address indicia appear. The invention teaches the use of opaque, stick-on numerals to form the address figures.

U.S. Pat. No. 4,009,535, issued to Stock (3/1/77) teaches the illumination of a plastic template in which the desired figures are cut out. By illuminating one side of the plastic template light will pass through the cutouts and be visible in the shape of the desired figures on the other. Once such a template is cut out the only way to change the display would be to create a new template.

U.S. Pat. No. 3,447,253, issued to Coad on June 3, 1969, teaches a series of figures which may be clamped to a pair of mounting rails. The mounting rails can be used to conduct electricity to the clamps, which further conducts electricity through an insulating mounting board upon which illuminated figures may be displayed.

U.S. Pat. No. 3,221,432, issued to Gold on Dec. 7, 1965, teaches a plurality of casings which are affixed in a linear array and adapted to accept figures for illumination. The installation and display of each figure also requires the installation and positioning of a receiving casing.

While a variety of different apparatus may be available to meet the needs of different situations, it is still a goal of the inventor to improve the art by continuing to enhance both the versatility of such a device and the attractiveness of the resulting display.

Such illuminated sign devices necessarily entail providing means for mounting upon an exterior or visible surface, delivering electrical energy to some form of mounting base, and a means whereby desired letters or numerals (illumination figures) may be fixed upon the mounting base for illumination. Accordingly, it is seen that such a device essentially amounts to an electrical appliance. Typically such devices come in discrete sizes and shapes and the consumer of such devices is somewhat restricted by the sizes and shapes available in the marketplace. Modification of the dimensions of such devices is a task which would normally require an electrician.

It should also be pointed out that electrical plugs and other apparatus associated with the connection of electricity from a power source to an applicance are made in certain standard sizes. Such standard sizes are made to accommodate particular uses such as for appliance outlets or track lighting slots. Despite the existence of such widespread standarization of electrical connection means and the need for more attractive and customized electrical illumination displays, it is still difficult to find a product enabling one to simply create an attractive yet versatile electrical illumination display.

SUMMARY OF THE INVENTION

The inventor has designed an apparatus which overcomes these particular shortcomings of the prior art. In particular, the means and apparatus are provided whereby a consumer not possessing electrical expertise may easily tailor the sign to the particular dimensions needed and easily adapt it with the desired illumination figure or figures.

The device generally comprises an elongated shell which may be simply cut with ordinary tools to any length desired by the user and capped on either end to facilitate weather-proofing. Within the elongated exterior shell is provided an electrical transmission member which generally comprises extruded or molded member which is adapted to house elongated electrical conductors. The conductors are positioned so as to accommodate standardized electrical plugs or electrical terminal members. The device may then be adapted so as to accept any number of illumination figures adapted with electrical plugs and they may be spaced or positioned in any manner desired by the user.

It is then, an object of the present invention to provide an apparatus susceptible to being cut to any desired length and adapted to accept standardized electrical power transmission devices.

It is a further object of the present invention to provide such an apparatus upon which electrical illumination figures may be securely mounted and displayed.

It is a further object of the present invention to provide such an apparatus which may be adapted for outdoor use with appropriate weather-proofing.

It is a further object of the present invention to provide such an apparatus which may be adapted with automatic on and off mechanisms to provide for illumination as required.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Description will now be provided in detail of the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
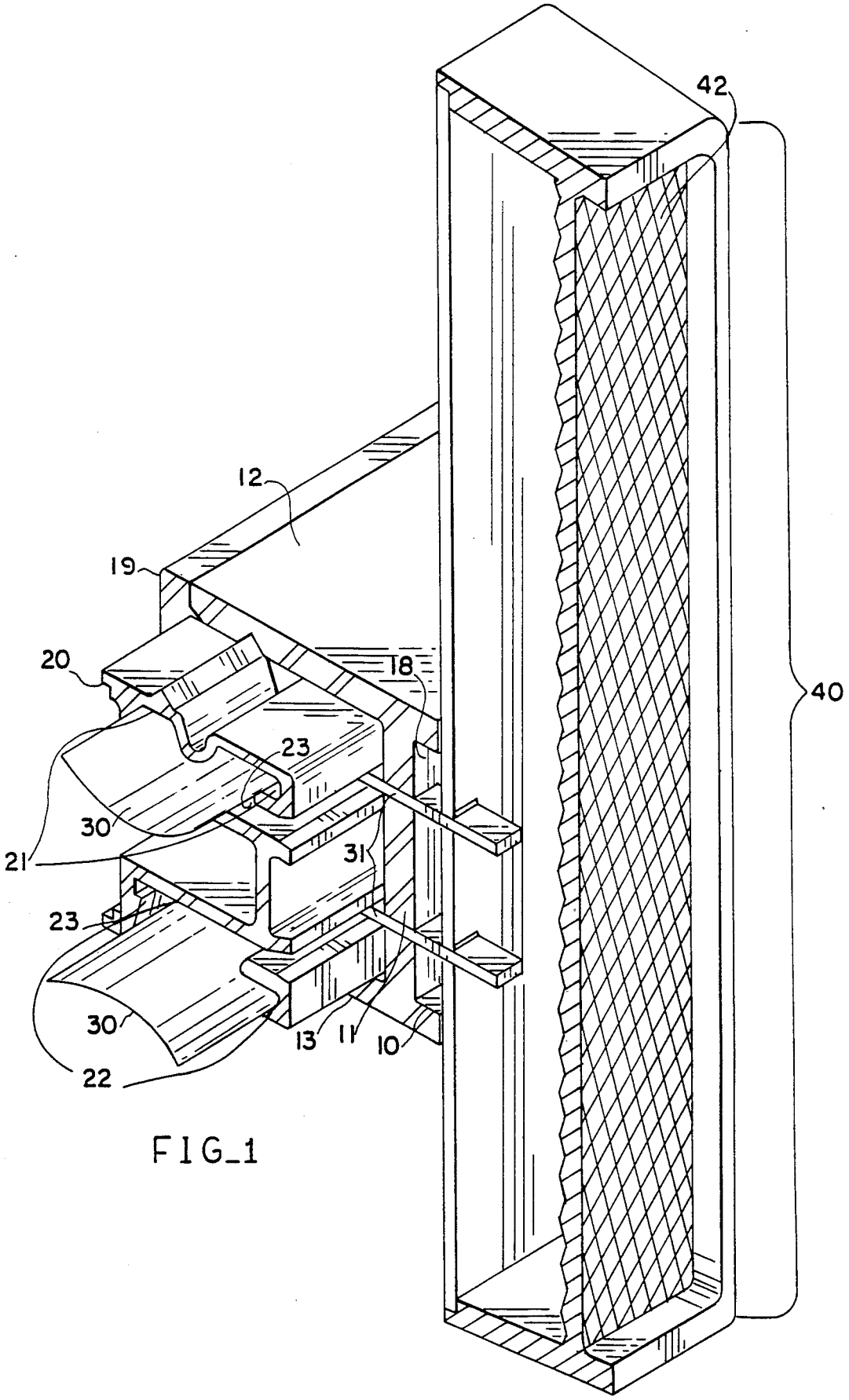
FIG. 1 is an oblique view of preferred embodiment of the present invention which the cut out section reveals the interior apparatus of the cover.

First making reference to FIG. 1 the major operative components of the apparatus as taught may be seen. An exterior shell (10) houses an elongated interior extrusion (20) which is further adapted with upper and lower pairs of slots (21, 22, respectively) which position electrical conducting strips (30) into a curved position, curving out into channels (23). The elongated interior extrusion channels (23) through which electrical conducting prongs (31) may be positioned to facilitate contact with the electrically conducting strips (30). These channels (23) are spaced so as to coincide with standardized electrical plugs for terminal means.

As can be further seen in FIG. 1, the elongated shell (10) further comprises a one piece front side (11), an upper side (12), and a lower side (13). The upper (12) and lower (13) sides extend out beyond the front side (11) so as to form a shallow mounting bay (18). The elongated shell (10) further comprises a detachable rear side (19).

Figure 2:
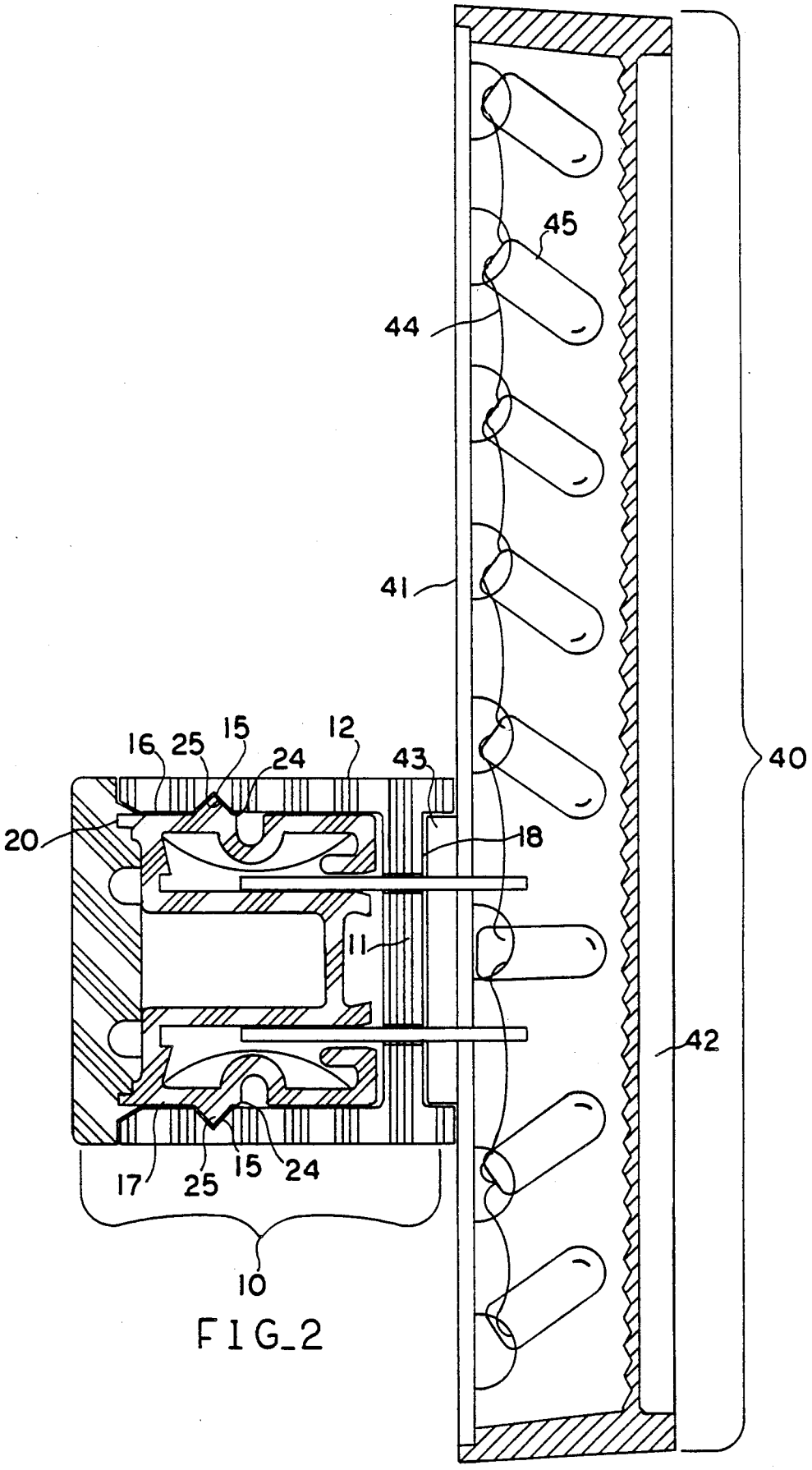
FIG. 2 is a cross-section of the preferred embodiment depicting the interior apparatus of both the cover and an illumination member.

As is shown in FIG. 2, wedges (25) may be placed on the outer surfaces (24) of the interior extrusion (20) which may be accepted by notches (15) on the interior upper (16) and lower (17) surfaces of the elongated shell (10) in order to facilitate guiding them together. However, this feature is only one way of accomplishing this task and it is possible to construct the invention with no guiding means.

Also depicted at FIG. 2 is the cross-section and interior of a figure for illumination (40) further showing its electrical connection with the interior of the elongated shell (10). Such a figure comprises an exterior mounting member (41), a light transmissive surface (42) and an interior electrical transmission (44) and illumination apparatus (45), which, as depicted, comprises a series of incandescent lights arrayed in the pattern of the desired number. In particular it is pointed out that the exterior mounting member (41) is further adapted with a means to facilitate precise mounting of the illumination figure (40) to the exterior shell (10) of the apparatus. This means may simply be provided by a stablization member (43) which is of suitable dimensions to snugly fit within the shallow mounting bay (18) between the upper (11) and lower (12) exterior shell (10) surfaces.

Figure 3:
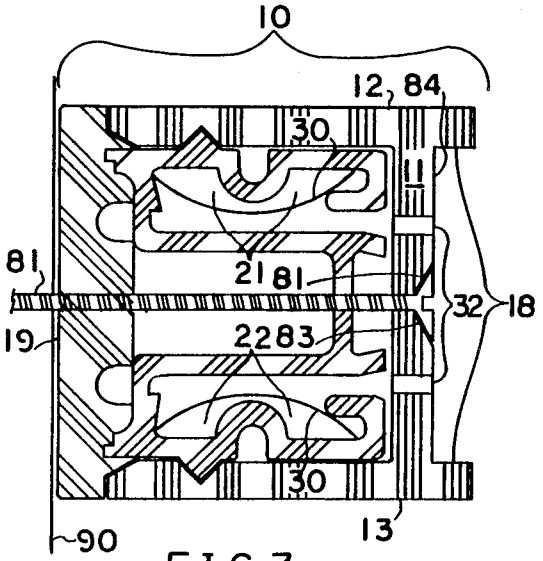
FIG. 3 is a cross-section view of the cover apparatus, further depicting a mounting screw.

In order to mount the apparatus to a wall or other upright surface, as depicted in FIG. 3, a bolt or screw (81) could be passed through the front side (11), between the strip conductors (21, 22), and through the rear side (19) for fastening the apparatus to the desired surface (90). The head (81) of the screw (81) would then be adapted to fit within a depression (83) in the front side (11) so as to remain flush with the front side surface (84). It should be noted that many acceptable methods of surface mounting may exist, such as adhesives or brackets, which do not depart from the spirit or scope of the invention.

Figures 1, 4, 6:
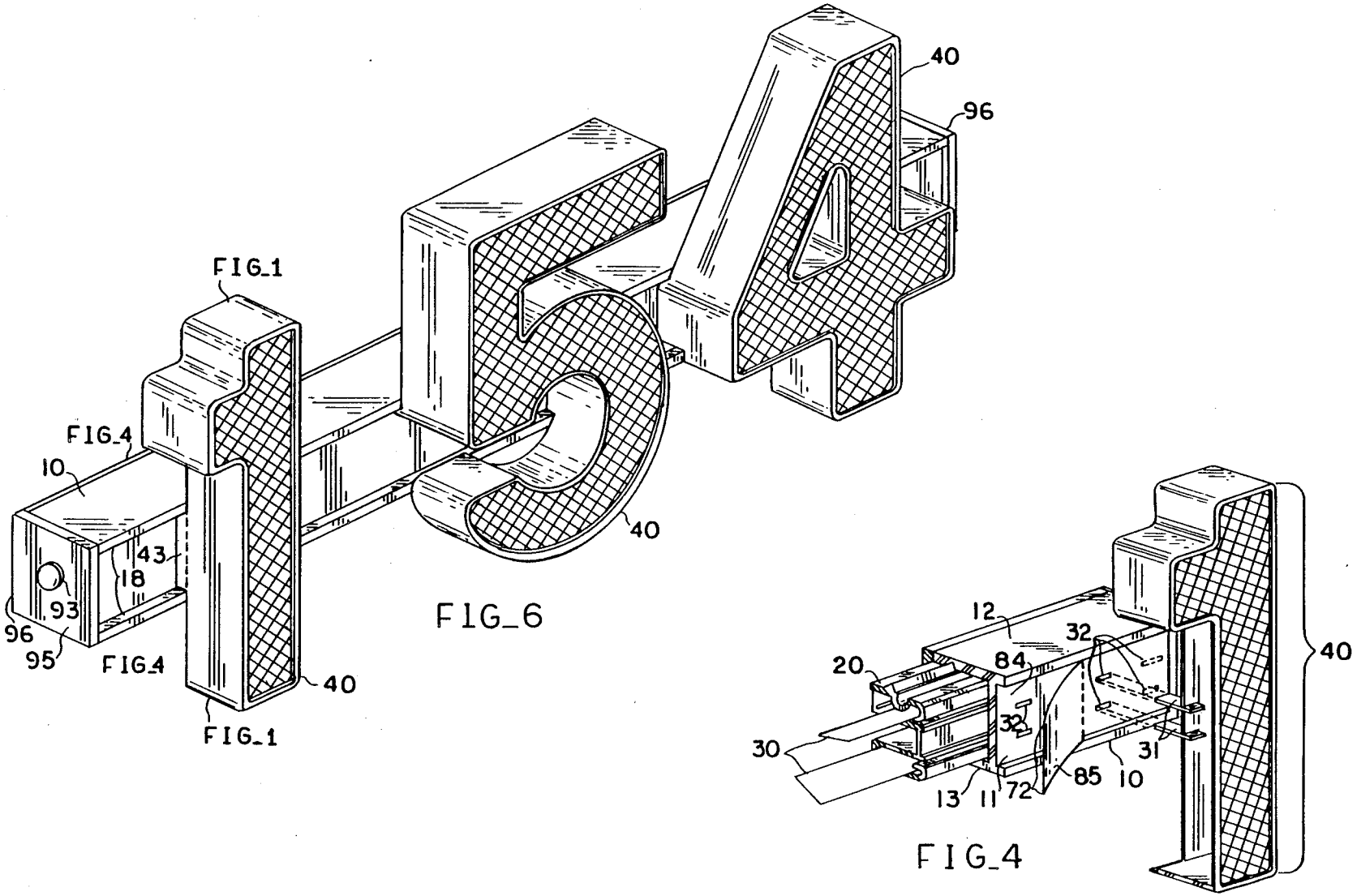
FIG. 4 is an oblique view depicting the insertion of an illuminated figure into the cover.
FIG. 6 depicts the apparatus in use which is further adapted with a photocell for automatic switching.

As is depicted in FIG. 4, the front side (11) is adapted with pairs of slots (32). The slot pairs (32) are positioned so as to permit the electrical prongs (31) of the figures (40) to be inserted into the shell (10) and make contact with the strip conductors (not depicted in FIG. 4). These slot pairs (32) may, but need not, be adapted to accept standard electrical plugs or track lighting fixtures.

In order to provide the capability of outdoor use of the apparatus, including during times of inclement weather, the slotted front surface (84) may be further adapted with an adhesive strip (85) covering the slot pairs (31), as is further depicted in FIG. 4. Such an adhesive strip covering (71) would be of sufficient width (72) to cover the slot pairs (31) on the front side (11) and could be cut to sufficient length to cover the entire length of the front side (11). The adhesive strip (71) should be thick enough to adequately waterproof the unused slot pairs (31) on the front side (11) but not to prevent the figure prongs (31) from being easily punched through it and into the slot pairs (32).

It should also be noted that the slot pairs (32) can (but need not) be regularly spaced so as to facilitate a wide measure of choice by the consumer concerning the positioning and spacing of the illuminated figures. Generally speaking, the closer together the slots are, the smaller the illuminated figures may be and also more latitude in spacing is provided.

Figure 5:
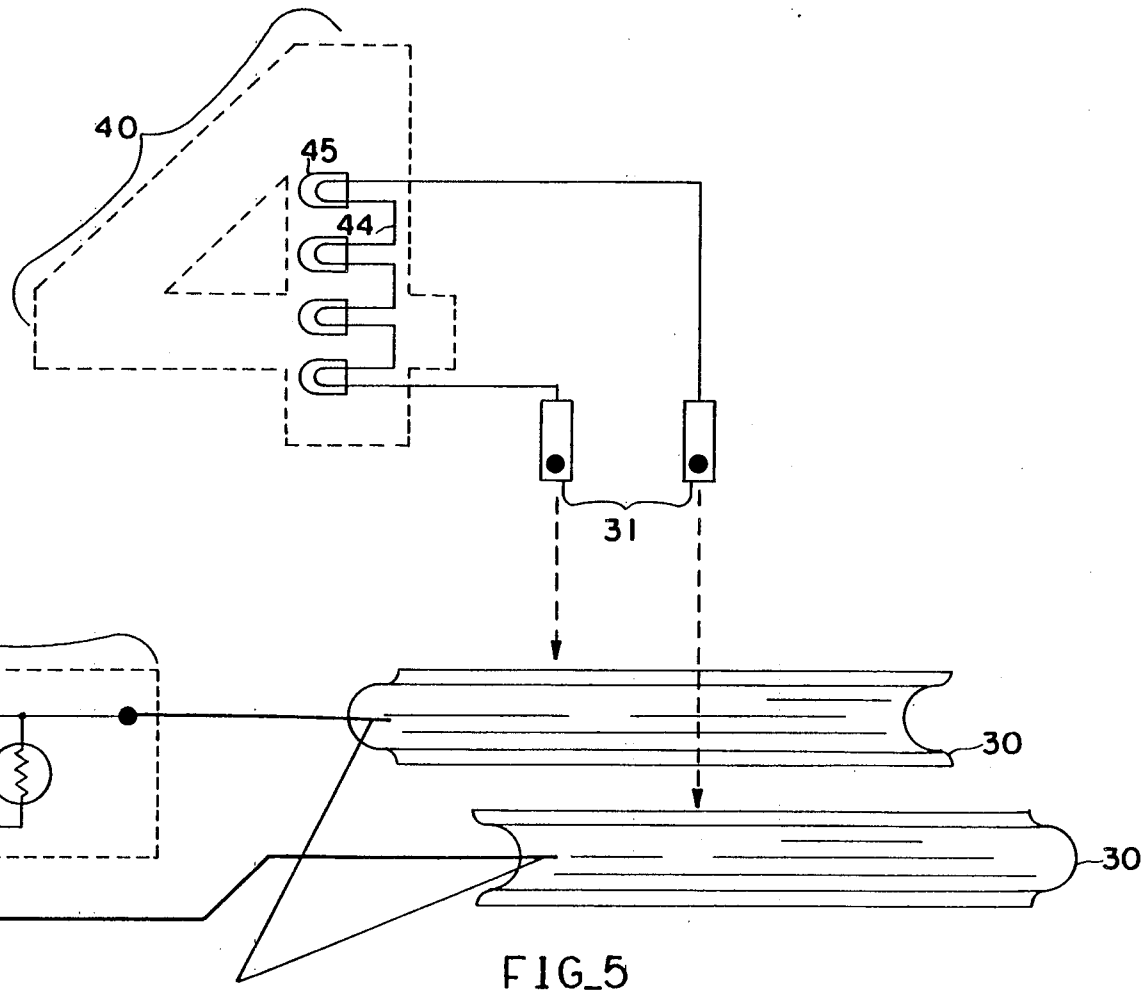
FIG. 5 is a schematic diagram of electrical circuitry which may be used to power the present invention.

In order to provide an automatic switching capability, the apparatus could be further adapted with a photocell (93, at FIG. 6) positioned on any exterior surface (95) of the apparatus in order to detect the intensity of the surrounding light. Such a photocell is shown in FIG. 6 and the circuitry is schematically depicted in FIG. 5. As shown in the schematic diagram at FIG. 5, the photocell could be used to trigger an on/off relay switch to turn the electrical illumination on when necessary for display. Electrical power (97) may be delivered into the shell (10) at any convenient place, although it would be desirable to enter the shell (10) at some point which is both protected and hidden from view.

FIG. 6 is a depiction of the apparatus as finally assembled. The ends of the elongated shell (10) may be simply capped with end caps (96) in order to seal and waterproof the shell (10). As long as the ends are cut off perpendicular to the length of the shell, the caps (96) may be made of a standard size and reliably provide a precise fit for any desired length of shell (10). The ends of the shell may be, however, closed and sealed in any desired manner. For indoor or protedted area use, no caps or sealing may be necessary at all.

It should also be noted that, while the preferred embodiment has been described with reference to a series of incandescent lights, any form of electrical illumination may be used. This may include a neon bulb, a glowing sheet, or flourescent lighting. Such forms of lighting are well known and need not be further described herein except to mention that the electrical connections through the channels (22) and prongs (31) would be exactly as shown and depicted herein.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. An apparatus for displaying illuminated figures comprising;

an elongated exterior cover, further comprising an elongated shell of rectangular cross-section which further comprises upper, lower, and front sides and one open rear side, said upper and lower sides protruding slightly beyond said front side;

an interior conduit member in which is adapted to snugly fit along the length of said elongated shell, said conduit member further adapted with upper and lower sets of mounting slots for elongated electrical conductors;

said upper set of mounting slots comprising two parallel slots which are positioned along the length of an upper surface of said conduit member so as to receive opposite edges of a strip of an electrical conducting material, said electrical conducting strip being curved across its width and protruding above said upper conduit surface;

said lower set of mounting slots comprising two parallel slots which are positioned along the length of a lower surface of said conduit member so as to receive opposite edges of a strip of an electrical conducting material, said electrical conducting strip being curved across its width and protruding above said lower conduit surface;

said upper and lower elongated shell sides being adapted so as to accept detachable rear cover;

said front side being further adapted with a series of regularly spaced upper slots and a series of regularly spaced lower slots, said series of upper slot each being positioned so as to permit an electrical conducting prong to snugly fit therethrough and make electrical contact across its width with said upper conducting strip and said series of lower slots each being positioned so as to permit an electrical conducting prong to snugly fit therethrough and make electrical contact across its width with said lower conducting strip;

said upper and lower series of slots running substantially parallel along the length of said front side;

one or more illumination figures, each said figure further comprising two electrically conducting prongs, a mounting member, electrical lighting mounted upon said mounting member in the pattern of a desired figure;

said mounting member further being adapted with a flat back surface which is adapted to fit across said front side, and upper and lower surfaces, which are adapted to snugly fit within extruding portions of said upper and lower shell sides;

said mounting member further adapted with said upper and lower electrical conducting prongs which are further adapted to extend through said mounting member and extend out between said upper and lower figure mounting surfaces;

said electrical conducting prongs further adapted with electrical conducting lines which are positioned so as to deliver electrical energy to said electrical lighting pattern;

said illumination figure being further adapted with a translucent cover, said translucent cover being adapted to prevent intrusion of moisture or water into said illuminated figure apparatus and to permit light from said pattern of electrical lighting to radiate therethrough; and said elongated exterior cover being further adapted with at least one part permitting the transmission of electrical engergy from a point outside said cover to said upper and lower electrical conducting strips.

2. The illumination apparatus described in claim 1 in which said front side is further adapted with a weatherproof adhesive strip covering said upper and lower series of slots, but permitting said electrical prongs to puncture and be inserted therethrough.

3. The illumination apparatus described in claim 1 which is further adapted with an automatic on-off photocell relay means, said automatic on-off means further comprising a photocell positioned upon said apparatus so as to detect and measure the intensity of the surrounding light and switch the electrical energy supply to said figures on and off as desired.

4. The illumination apparatus in claim 1 in which said exterior cover is further adapted with caps at each end, said caps adapted to prevent the intrusion of moisture within the area enclosed by said back, upper, and lower cover sides and said detachable front cover.

5. The illumination apparatus described in claim 1 in which is further adapted with mounting means for mounting said apparatus upon a flat surface, the mounting means further comprising a mounting screw which may be passed through said front side, the interior of said elongated shell between said elongated conducting strips, and through said back side so as to permit fastening to a desired surface, the head of said screw being further provided with a flat head adapted to fit flush with said front side surface within a recessed portion on said front side surface.

6. The illumination apparatus described in claim 5 which is further adapted with a weatherproof adhesive strip covering said upper and lower series of slots, but permitting said electrical prongs to puncture and be inserted therethrough.

7. The illumination apparatus described in claim 5 which is further adapted with an automatic on-off photocell relay means, said automatic on-off means further comprising a photocell positioned upon said apparatus so as to detect and measure the intensity of the surrounding light and switch the electrical energy supply to said figures on and off as desired.

8. The illumination apparatus described in claim 5 which is further adapted with caps at each end, said caps adapted to prevent the intrusion of moisture within the area enclosed by said back, upper, and lower cover sides and said detachable front cover.

9. The illumination apparatus described in any one of claims 1 through 8 in which said electrical lighting comprises either a series of incandescent bulbs, a neon light, a glowing sheet, or a flourescent light.

* * * * *